United States Patent [19]

Ramon

[11] 4,189,295

[45] Feb. 19, 1980

[54] CONTROL FOR HEATING APPARATUS

[75] Inventor: Noel A. Ramon, Brugge, Belgium

[73] Assignee: Naamloze Vennootschap A. Claeys-Flandria, Zedelgem, Belgium

[21] Appl. No.: 811,311

[22] Filed: Jun. 28, 1977

[30] Foreign Application Priority Data

Jun. 28, 1976 [BE] Belgium ..... 168409
Jun. 21, 1977 [BE] Belgium ..... 178626

[51] Int. Cl.[2] ..... F23N 3/04
[52] U.S. Cl. ..... 431/12; 431/20
[58] Field of Search ..... 431/12, 20, 76, 89; 236/45

[56] References Cited

U.S. PATENT DOCUMENTS

| | | | |
|---|---|---|---|
| 2,028,249 | 1/1936 | Ross | 431/20 X |
| 2,217,518 | 10/1940 | Merkt | 431/20 X |
| 2,374,606 | 4/1945 | McCollum | 431/12 X |
| 3,015,357 | 1/1962 | Bain et al. | 431/76 X |
| 3,074,644 | 1/1963 | Geniesse | 431/76 X |
| 3,146,821 | 9/1964 | Wuetig | 431/20 X |
| 3,307,613 | 3/1967 | Rexer | 431/76 |
| 3,503,553 | 3/1970 | Schomaker | 431/76 X |

FOREIGN PATENT DOCUMENTS

| | | |
|---|---|---|
| 2113554 | 6/1972 | France . |
| 2234820 | 1/1976 | France . |
| 1367793 | 9/1974 | United Kingdom . |

*Primary Examiner*—William E. Lyddane
*Attorney, Agent, or Firm*—Kurt Kelman

[57] ABSTRACT

A combustion chamber-heat exchanger apparatus, wherein air is forced into the combustion chamber and combustion gases are forced out of the heat exchange, is operated at optimum efficiency by detecting in the combustion gases parameter corresponding to the composition and/or temperature thereof and modifying the fluid flow through the fluid flow circuit in response to the detected parameter until the volume of air forced into the combustion chamber corresponds to the volume of air necessary for obtaining the maximum efficiency of the apparatus under the detected condition of operation.

1 Claim, 17 Drawing Figures

CONTROL FOR HEATING APPARATUS

The present invention relates improvements in processes and equipment for maintaining substantially constant, at its optimum level for various conditions of operation, the output of sealed heating apparatus, comprising a combustion device as well as a forced admission of air and removal of combustion gases.

This type of sealed apparatus has been developed in the last few years, especially in relation to space heating apparatus, water-heating apparatus, etc.

Most of these devices operate on gas, although other combustible materials could be used.

These devices comprise a burner arranged in a combustion chamber, a heat exchanger attached thereto.

The supply of air for combustion and the removal of the combustion gases are effected by a fan arranged either upstream of the combustion chamber—heat exchanger assembly, which is thus fed under pressure, or downstream of the assembly, which is thus fed by suction.

The use of a fan for feeding the combustion chamber with air and removing the combustion gases results in major difficulties. In effect, the flow of fluid (air and combustion gases) is at all times principally determined by the characteristics of the fan as a function of the flow conditions (pressure drops) in the apparatus. However, the flow of combustion air necessary is determined by the condition of operation of the combustion device. Because of this fact, the majority of devices of this type are designed for a fixed condition of operation and operate in a go or no-go manner.

Figure 1:
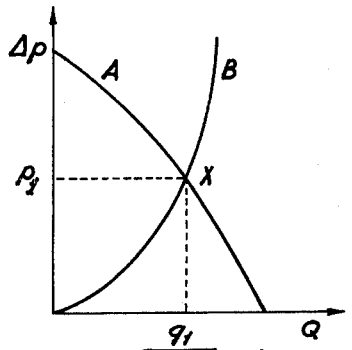
Figure 2:
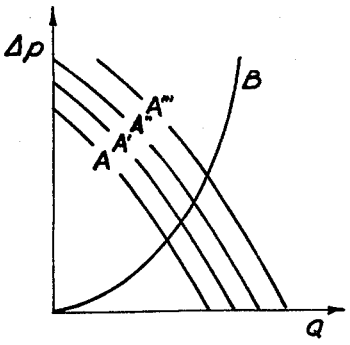
Figure 3:
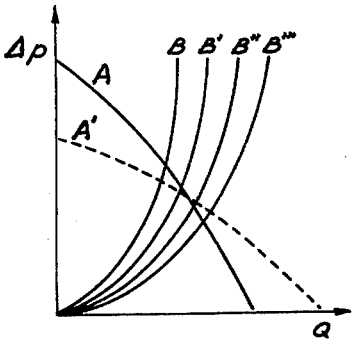

The operation of these devices will be better understood by reference to FIGS. 1, 2 and 3 of the accompanying drawings which show various diagrams of flow as a function of pressure for fans, in combination with curves of the resistance to flow in the assemblies of combustion chamber with heat exchanger. FIGS. 1 and 2 represent prior art.

FIG. 1 shows a characteristic curve A for a fan driven at a nominal speed and a curve B for the flow resistance of a heating apparatus. These two curves cross at a point X which determines the conditions of pressure $p_1$ and of flow $q_1$ prevailing in the apparatus during operation of the fan.

In devices with go or no-go control, the characteristics of the fan and of the heating apparatus are chosen so that the flow $q_1$ corresponds to the ideal flow for the single designed condition. It will be appreciated immediately that if other conditions of operation are required in the apparatus, the flow of air being substantially constant, there results either a deficit of combustion air or an excess; in both cases, the output of the apparatus falls very rapidly.

However, in reality, the needs of the user turn, on the one hand, towards increased comfort and, on the other hand, towards economy in the means (costs of purchase, installation and use) necessary for achieving this comfort.

The improvement in comfort can be attained by a modulating control of the apparatus, such as for example a modulating thermostatic control of a heating apparatus, while the economy of means is achieved by ensuring a high efficiency from the apparatus for each of the designed conditions.

These aims are attained by providing a modification of the flow of combustion air driven by the fan through the assembly of combustion chamber and heat exchanger as a function of the condition of operation of the apparatus.

A solution has already been proposed in this manner by providing a modification of the state of the fan, that is to say by establishing, as shown in FIG. 2, a family of curves A, A', A'', A''' for the fan which allows, as a function of the flow conditions B in the apparatus, a series of combustion air flows to be obtained in the combustion chamber. This prior art solution however requires for the drive of the fan the use of a variable speed motor which, in the existing embodiment, is controlled by the flow of combustible at the principal burner.

This manner of realisation, while relatively satisfactory, is expensive and requires complicated controls.

The present invention regulates the problem of obtaining a variable flow of air, as a function of the condition of operation in the combustion chamber, in a totally different manner.

According to the invention, the conditions of resistance to the flow of fluid in the apparatus are modified, as shown in FIG. 3, in such a way as to obtain a series of curves of flow resistance B, B', B'', B''' which, in combination with the fixed curve of operation A of the fan, ensures that a continuous range of flows is obtained in the combustion chamber in correspondence with the heat output of the apparatus determined only by detecting the temperature of the combustion gases.

This is achieved by control of the flow cross-section for the air or the combustion gases, at a fixed point in the apparatus, as a function of the temperature of the non-diluted combustion gases.

In all cases, to obtain conditions of flexibility of operation and ease of the required control, a fan is preferably used whose operating curve A (see FIG. 3) is relatively steeply inclined, that is to say for which a relatively large change of pressure produces a relatively smaller change of flow. This is explained more fully below.

Moreover, in order to avoid having the fan work at pressures which are too high, there is provided a branch from the combustion chamber which is a connection between the supply conduit for fresh air and the conduit for removal of the combustion gases, which increases the total throughput of the fan in the apparatus.

The modification of the flow resistance conditions resulting in a variation of the flow of combustion air into the combustion chamber will be achieved by a variable restriction of the flow cross-section controlled in dependence upon the temperature of the non-diluted combustion gases, which is a function of the condition of operation and arranged at any point of the circulation of fluid driven by the fan.

The constriction can be arranged either in the air supply conduit, or in the branch provided between the supply of air and the removal of combustion gases, or in the circuit of the combustion chamber itself (including the exchanger), or by a combination of these possibilities.

The detection of the condition of operation, is ensured by a bimetallic device sensitive to the temperature of the combustion gases inserted in the combustion gas circuit.

Detection by a device sensitive to the flow or to the pressure, inserted in the device for feeding combustible to the burner(s) does not furnish sufficient parameters to be applied usefully to the invention.

Figure 4:
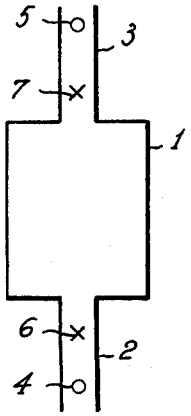
Figure 5:
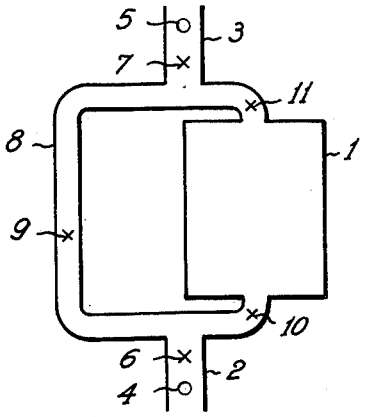
Figure 6:
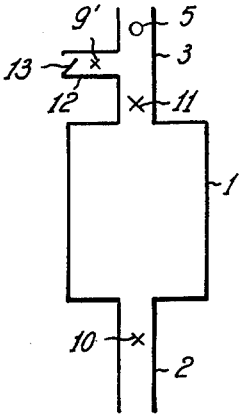
Figure 8:
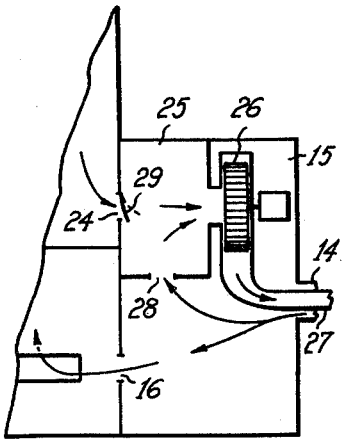
Figure 9:
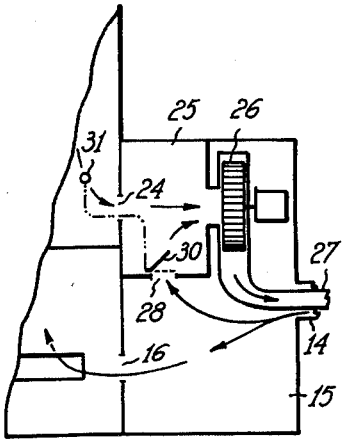
Figure 10:
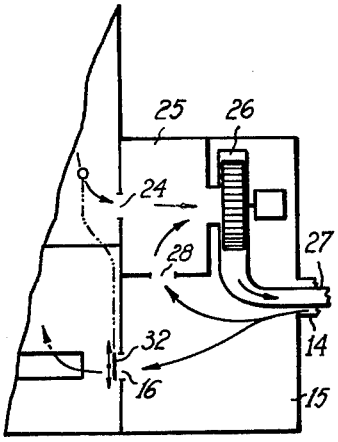
Figure 7:
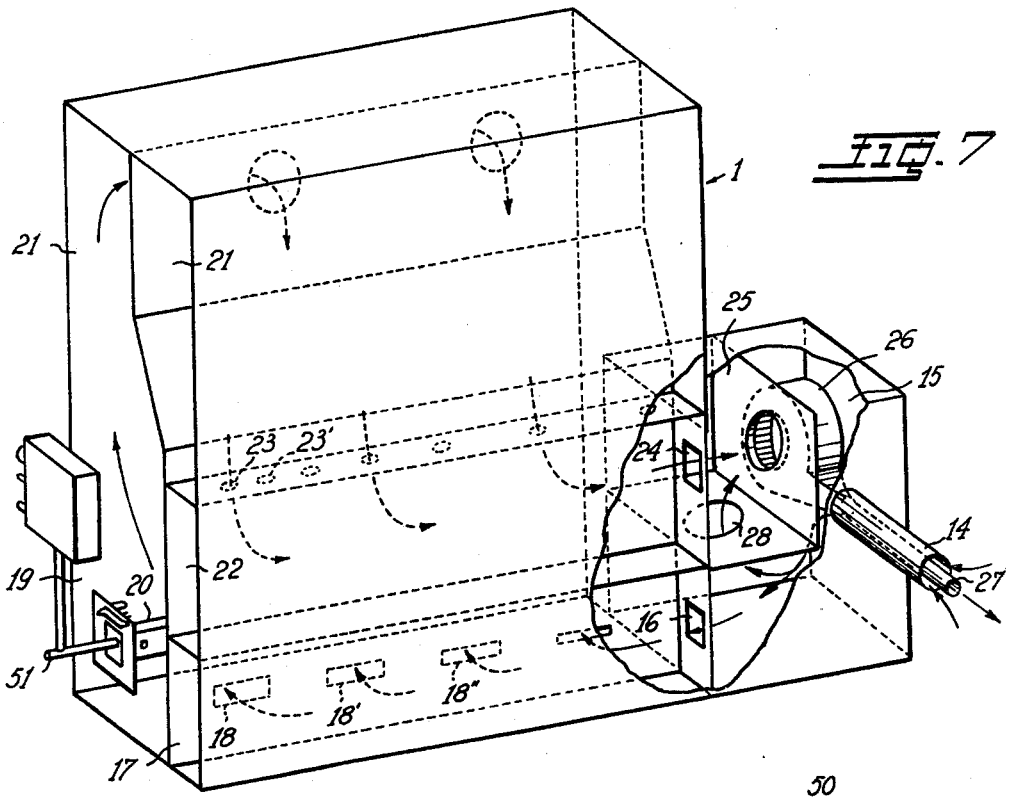
Figure 11:
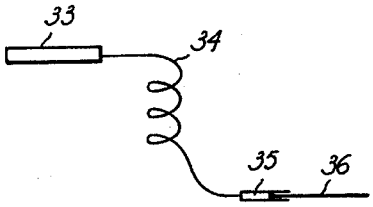
Figure 12:
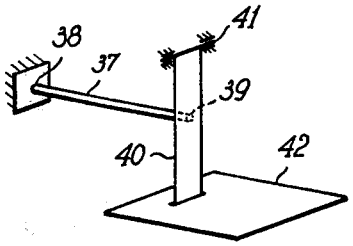
Figure 14:
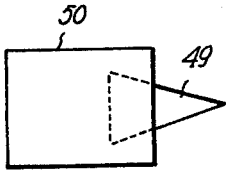
Figure 15:
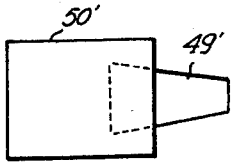
Figure 13:
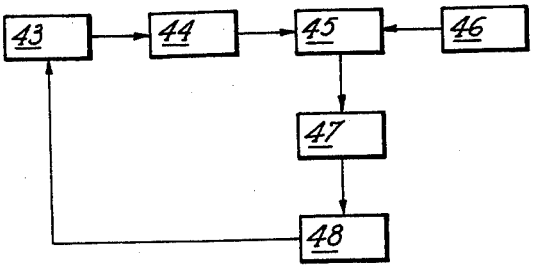
Figure 16:
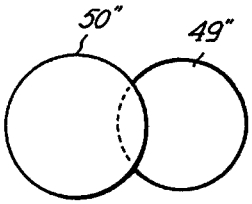
Figure 17:
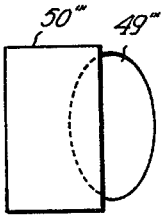

The invention will be better understood by reference to the description together with the attached drawings which show, solely by way of example, various embodiments of the invention and in which:

FIGS. 1 to 3 are diagrams giving the curves of operation of the fans and the curves of flow resistance in the sealed apparatus, FIGS. 1 and 2 referring to the prior art, FIG. 4 shows schematically the various controls possible according to the invention in a sealed apparatus including a branch in parallel with the combustion chamber and the heat exchanger conducting air from the air supply conduit into the combustion gas exhaust conduit, FIG. 5 shows, in perspective, certain parts of the housing having been removed, a preferred embodiment of the invention applied to a gas heating apparatus, FIG. 6 is a partial front view of the apparatus of FIG. 5, showing the position of the bimetallic device for the detection of the temperature of the combustion gases and for control of the flow resistance in the apparatus.

Referring to FIG. 4, reference 1 designates the assembly of the combustion chamber and the heat exchanger, while references 2 and 3 respectively designate the air supply conduit and the exhaust conduit for the combustion or burnt gases.

The fan can be placed either at 4, that is to say in the air supply conduit 2, and the assembly of combustion chamber and heat exchanger thus works under superatmospheric pressure, or at 5, that is to say in the exhaust conduit 3 for the diluted combustion gases and the assembly of combustion chamber and heat exchanger then works under reduced pressure.

Air supply conduit 2 leads to two different fluid flow circuits: a first one including fresh air inlet 6, assembly 1 of the combustion chamber and heat exchanger and an outlet 7 for combustion gases, and a second circuit including branch 8 which establishes direct communication between air supply conduit 2 and exhaust conduit 3 for the combustion gases. The combustion gases circulating in exhaust conduit 3 are those coming from outlet 7 and diluted by air coming through branch 8.

A bimetallic constriction device is disposed at addition to the positions 6 and 7 located respectively in the supply conduit 2 and the exhaust conduit 3, either at any point 9 in the branch 8, or at the inlet 10 to the combustion chamber, or at the outlet 11 of the non-diluted combustion gases coming from the heat exchange of assembly 1, to detect the gas temperature and to constrict the flow of the gases produced by fan 4.

Whatever the position of the fluid flow constriction, the cross-section which it leaves open will be controlled at all times in dependence upon the temperature of the non-diluted combustion gases, which is a representative parameter of the condition of operation of the apparatus, in order to obtain a flow of combustion air into the assembly of combustion chamber and heat exchanger ensuring a practically constant efficiency of the apparatus at least close to the optimum efficiency.

By "condition of operation" should be understood the operation of the apparatus at different rates of heating controlled, for example, by a thermostatic modulating control of the combustible and thus of the combustion, in dependence upon the characteristics of the fan, changes in voltage, atmospheric conditions, and other possible disturbances which could have an influence on the operation of the apparatus (see table below).

It must be noted that the amounts of air required for combustion, on the one hand in the minimum condition and on the other hand in the maximum condition, assuming that the quantities of combustible consumed in these two conditions differ in the proportion of 1 to 10, likewise vary in the proportion of 1 to 10. In all cases, considering that in low conditions the quantity of excess air influences the efficiency of the apparatus less than in high conditions, one can allow the amounts of air supplied to the combustion chamber to vary in the proportions of 1 to 4, ensuring for various conditions a practically constant optimum efficiency of the apparatus.

The temperature detecting and flow control element being constituted by a bimetallic constrictor device at 11, the flow resistance in the assembly of combustion chamber and heat exchanger is thus modified as a function of the condition of operation of the apparatus. In this case a diminution of the condition of operation leads to an increase in the flow resistance in the assembly of combustion chamber and heat exchanger, as a result of which the volume of fluid driven into the assembly of combustion chamber and heat exchanger falls. The consequent increase in the pressure difference acting both on the branch 8 and on the assembly of combustion chamber and heat exchanger 1 as a function of the characteristics of the fan, entails as a consequence that a greater volume of air is caused to flow through the unchanged cross-section of the branch to dilute the combustion gases.

It is equally possible to add these two effects by providing both in the branch 8 and in the circuit of the assembly of combustion chamber and heat exchanger 1 two constrictors operating in opposite senses.

This allows a particularly convenient control of the flow in the assembly of combustion chamber and heat exchanger, while limiting the total variation of the flow of the fan to a relatively restricted zone of its operating curve.

Since an admission of air is provided in the exhaust conduit for the combustion gases 3, one benefits, in addition to the easier control of the volumes of combustion air, from a cooling of the combustion gases. In the various cases examined above, the cross-section left open by the constriction(s) formed is determined all the time as a function of a single factor relating to the condition of operation, that is to say in practice to the temperature of the non-diluted combustion gases gathered in the assembly of combustion chamber and heat exchanger 1.

The arrangement according to the invention is thus self-correcting because a modification of the condition of operation entails an immediate modification of the needs for combustion air in the combustion chamber. The detection of the change of the condition of operation by way of the detection of a single parameter results in a positive action on the device for modifying the flow resistance, in the sense of adjusting the volume of air in the assembly of combustion chamber and heat exchanger to the air requirements of the new condition of operation.

The arrangement in accordance with the invention allows a considerable economy of combustible because at each instant the flow resistance which depends on the condition of operation of the apparatus produces as a function of the characteristics of the fan a pressure difference which delivers to the combustion chamber the quantity of air necessary to guarantee combustion with a practically optimum efficiency.

To maintain the efficiency practically constant at an optimal value and control the combustion and especially the quantity of excess air in the assembly of combustion chamber and heat exchanger, one could theoretically act on the flow resistance of the apparatus in consequence of the detection of various single parameters such as detection of the $O_2$ content of the combustion gases detection of the temperature of the combustion gases, preferably at the outlet of the heat exchanger detection of the content of one or more of the constituents of the combustion gases (% $CO_2$, % $H_2O$, % $N_2$ . . . )

detection of the flow of combustible supplied to the main burner (to the burners)

detection of the pressure of the combustible supplied to the main burner (to the burners)

detection of the calorific flow of the combustible supplied to the main burner (to the burners).

The possibilities of these various procedures, used in conjunction with the devices for modifying the flow resistance in the apparatus, as a function of the various disturbances which can influence the operation of the apparatus, are examined in the table below.

TABLE

| Modifications and disturbances of the condition of operation resulting from: / Valves detected concerning | Combustion gases | | | Combustible | | |
|---|---|---|---|---|---|---|
| | % $O_2$ | Temperature | % $CO_2$ or % $N_2$ or % $H_2O$ | Pressure | Flow | Heat flow |
| Modification of the characteristics of the combustible (for example lower or higher calorific value, density, composition) | + | + | − | − | − | + |
| Change in the electric supply (voltage or frequency) | + | + | + | − | − | − |
| Tolerance in the operation of the fan (curve $\Delta_{p-Q}$) | + | + | + | − | − | − |
| Change of combustible within a predetermined group (solid, liquid or gaseous) | + | ± | to be adjusted | − | − | to be adjusted |
| Influence of the wind | + | + | + | − | − | − |
| Modification of the supply pressure of the combustible | + | + | + | + | + | + |
| Modification of the feed rate of the combustible | + | + | + | ± | + | + |
| Modification of the flow resistance (pressure drops) in the apparatus | + | + | + | − | − | − |

In this table:

The sign + indicates that the disturbance is detected and automatically corrected by a corresponding modification of the flow of air into the combustion chamber to eliminate the disequilibrium produced by the disturbance;

The sign ± indicates that the disturbance is only partially detected, and thus the correction effected is likewise only partial;

The sign − indicates that the disturbance is not detected and that no correction is effected.

The causes of disturbance are thus many and if they are not all detected the quantity of excess air which should be provided may lead to an inadmissible fall in efficiency.

The devices for monitoring the condition of operation contributing to the realisation of the present invention will be described herein below as devices for the detection of the temperature of the combustion gases.

By detecting the temperature of the combustion gases, the difference between the theoretical temperature of the flame of various combustibles (which is not itself detected) is partially levelled out by the heat exchanger. The difference in the amount of excess air having to be provided in connection with the difference in combustion temperature is of the order of 5% while the total amount of excess air which has to be provided to ensure complete combustion in the presence of the various possible disturbances is much greater than this 5%. The error due to the temperature detection system thus does not imperil the good operation of the apparatus.

If in the control of an element relative to the condition of operation, the detection of all the causes of disturbance such as for example a modification of the characteristics of the combustible, etc., is not possible, it is necessary to provide a supplementary quantity of excess air such that the disturbances cannot influence the combustion. Too large a quantity of excess air leads, however, for a fixed heat exchange area and for identical calorific characteristics of the apparatus, to a rapid large, reduction of efficiency, inadmissible if one wishes to maintain an efficiency close to the optimum efficiency of the apparatus.

FIGS. 5 and 6 represent a preferred embodiment of the invention.

FIG. 5 shows in a more detailed manner a preferred embodiment of the invention as shown schematically in FIG. 4, in which the fan occupies the position indicated at 5 in FIG. 4, and applied to a gas heating apparatus. The air is supplied by an air supply conduit 14 to a sealed inlet casing 15 connected by an opening 16 to the assembly of combustion chamber and heat exchanger 1. The air passes through the orifice 16 into an inlet distribution channel 17, whence it flows by way of the orifices 18, 18',18'' into the combustion chamber proper 19, where it is distributed along the length of the main burner 20. The gases resulting from the combustion enter a heat exchanger 21. They are guided towards an escape header, passing through orifices 23, 23', 23''. From the header they enter, through an orifice 24, an outlet casing 25. The gases having entered the outlet casing 25 are drawn off by a fan 26 and expelled through an escape conduit 27. An opening 28 forms the branch between the inlet casing 15 and the outlet casing 25, which is shown at 8 in FIG. 4.

For clarity in the drawing neither the variable fluid flow constriction devices nor the means for detection of the condition of operation of the apparatus have been shown in FIG. 5.

According to the embodiment of FIG. 6, the fluid flow constriction is effected at the orifice 24 (corresponding to position 11 of FIG. 4).

The control is effected, according to the invention, by disposing a bimetallic valve 29 at the opening 24 at the outlet from the heat exchanger. For a low temperature of the combustion gases, and thus for a light condition of operation of the apparatus, the bimetallic elements control the cross-section to a small value, whereas for a heavy condition of operation, the combustion gases being at a high temperature, the bimetallic elements curve and open a flow cross-section which is much larger. This entails a reduction of the pressure drop in the assembly of combustion chamber and heat exchanger, through which, as a function of the characteristics of the fan, a larger quantity of fluid is drawn.

This bimetallic valve 29, which is both a detecting and a control device, detects the condition of operation of the apparatus indirectly by detection of the temperature of the combustion gases, and controls the resistance to flow of fluid through the assembly of combustion chamber and heat exchanger by a greater or smaller opening of the bimetallic valve which regulates the flow cross-section.

It should be noted that in all cases, in order to ensure a satisfactory efficiency of the apparatus, it is necessary that the response of the combination of the device for detecting the condition of operation and the device for regulation of the flow resistance should be as rapid as possible. On the speed of this response depends in fact an adequate supply of combustion air at all times to the assembly of combustion chamber and heat exchanger.

This invention has been disclosed and illustrated by way of non limitative example and it is apparent that numerous modifications may be provided by carrying it out without departing from the scope thereof.

What we claim is:

1. A heating apparatus comprising a sealed casing holding a combustion chamber, combustion means in the chamber, means for supplying a combustible to the combustion means, heat exchange means associated with the combustion chamber, a first fluid flow circuit including an inlet conduit for air leading to the combustion chamber and an outlet conduit for non-diluted combustion gases leading from the heat exchange means, a second fluid flow circuit including a by-pass branching off directly from the air inlet conduit to the outlet conduit for the non-diluted combustion gases, a fan means forcing the air through the first circuit from the inlet conduit to the combustion chamber and forcing the non-diluted combustion gases through the outlet, and forcing the air through the second circuit by-pass, the fan means being arranged to exhaust the combustion gases from the first circuit and the air from the by-pass together, and means including a bimetallic device for detecting the temperature of the combustion gases coming from the heat exchange means arranged in the first circuit in the outlet conduit for the non-diluted combustion gases and being responsive to the detected temperature for modifying the fluid flow through at least one of the circuits until the volume of the air forced through the first circuit into the combustion chamber corresponds to the volume of air necessary for obtaining an operating efficiency at least close to an optimum efficiency of the heating apparatus under the detected temperature, supplementary air volume passing through the second circuit.

* * * * *

UNITED STATES PATENT AND TRADEMARK OFFICE

CERTIFICATE OF CORRECTION

PATENT NO. : 4,189,295

DATED : February 19, 1980

INVENTOR(S) : Noel A. Ramon

It is certified that error appears in the above—identified patent and that said Letters Patent is hereby corrected as shown below:

The title page and the 2 sheets of drawings should be deleted and the attached title page and 2 sheets of drawings substituted respectively therefor.

On the title page, below the abstract, change "17 Drawing Figures" to read -- 6 Drawing Figures--.

Signed and Sealed this

*Eighth* Day of *July 1980*

[SEAL]

*Attest:*

SIDNEY A. DIAMOND

*Attesting Officer*

*Commissioner of Patents and Trademarks*